United States Patent [19]

Cooper

[11] 4,138,832

[45] Feb. 13, 1979

[54] HOLE FILLING MACHINE

[76] Inventor: Carl Cooper, South Road 28, Ballantine, Mont. 59006

[21] Appl. No.: 814,143

[22] Filed: Jul. 11, 1977

[51] Int. Cl.[2] ..... E02F 5/22

[52] U.S. Cl. ..... 37/142.5

[58] Field of Search ..... 37/142.5; 61/63

[56] References Cited

FOREIGN PATENT DOCUMENTS 245578 11/1960 Australia ..... 37/142.5

388107 10/1973 U.S.S.R. ..... 37/142.5

*Primary Examiner*—Clifford D. Crowder

*Attorney, Agent, or Firm*—Arthur L. Urban

[57] ABSTRACT

A hole filling machine comprising a driven vehicle having a frame with a substantially horizontal rotatable blade assembly adjustably suspended therefrom. The assembly includes a circular housing with a central opening having a driven, rotatable, hollow vertical shaft disposed axially thereof. A plurality of arcuate blades extend outwardly from the shaft toward the periphery of the housing. A safety switch is operatively connected to both the drive for the vehicle and the shaft.

10 Claims, 5 Drawing Figures

FIG. 3
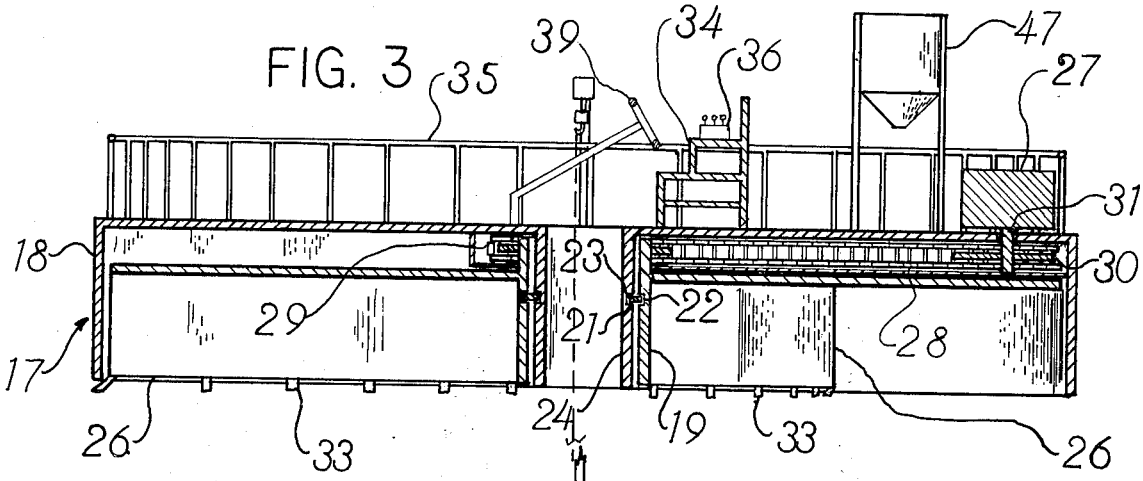
FIG. 4
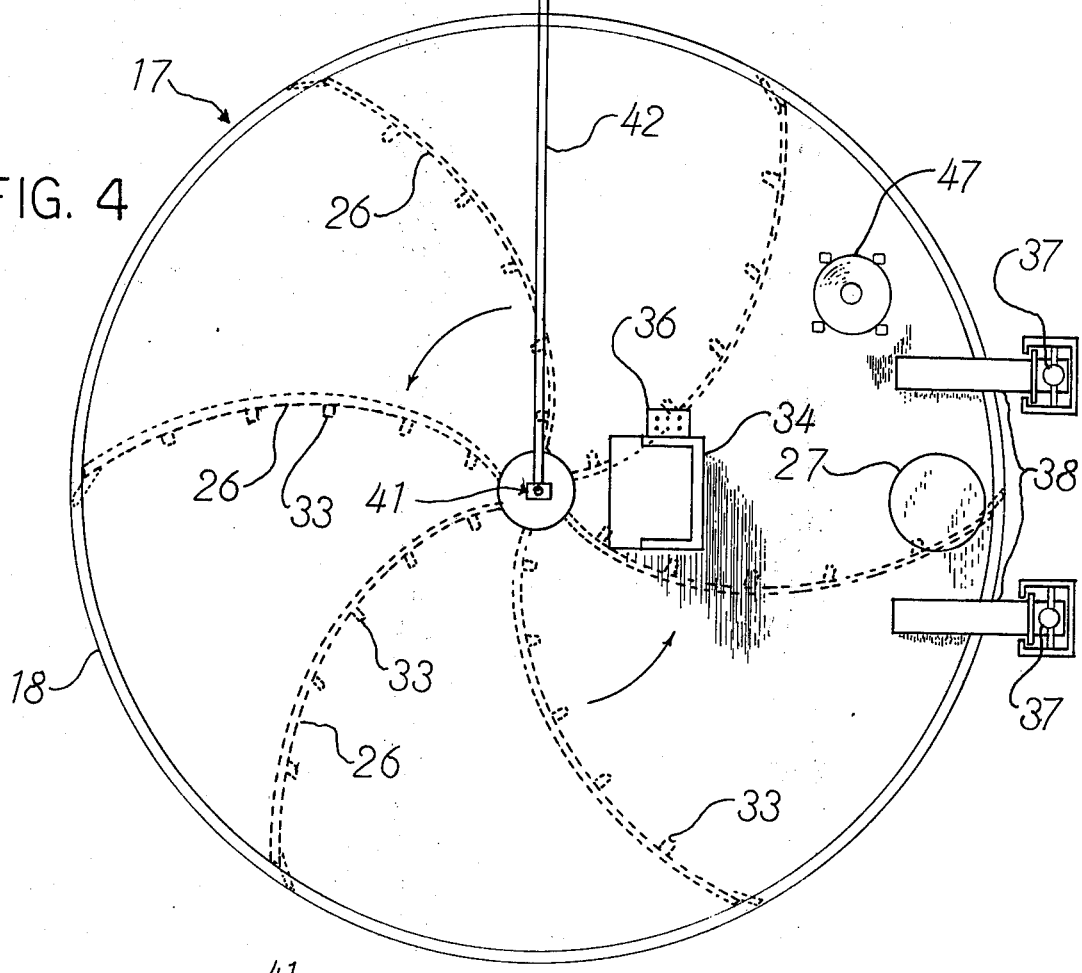
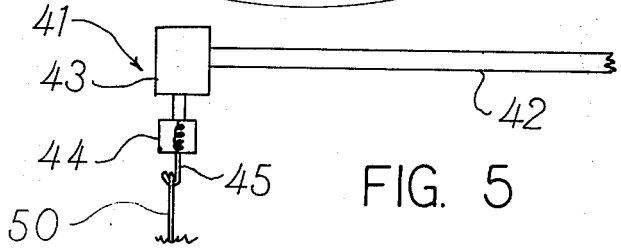
FIG. 5

HOLE FILLING MACHINE

This invention relates to a novel machine for filling holes and more particularly relates to a machine for back filling holes containing explosives.

In the strip mining of coal, it is customary to loosen the soil or overburden above the vein of coal by detonating an explosive charge in the soil. This generally is accomplished by drilling holes into the soil, placing a cast primer into the bottom, running a primer cord or lead to the surface, loading the hole with the required explosives and back filling the hole with soil. Great care must be exercised in the backfilling of the hole to avoid damage to the primer cord. If the primer cord is broken, it may not be possible to detonate the explosives in the hole. This presents a serious hazard since the explosives cannot remain undetonated in the hole because of the possibility they might explode accidentally with a loss of life and/or equipment. Thus, improper backfilling of holes containing explosives can create major problems.

In an attempt to avoid the possibility of damage to the primer cord, it has been proposed to leave the hole open but when this is done, most of the energy created when the explosives are detonated is dissipated back up the hole rather than into the area around the charge. Conventional earth moving machinery cannot be used safely because it does not provide sufficient control to insure that the primer cord will not be damaged. In view of these difficulties, present practice is to backfill the holes by hand shoveling. Hand shoveling, however, is not considered the ideal solution because of the limited time available to fill each hole, the large quantity of material to be returned to the hole and the large number of holes which must be backfilled each day.

A typical hole may be about one foot in diameter with a depth of forty to sixty feet or more. The explosive charge only fills about half the hole so a large amount of soil must be shoveled into the hole to fill it. This requires a considerable period of time even with several men doing the job. Since a large number of holes must be drilled each day before the earth moving equipment can begin working in the area, it is important that the time required to place an explosive charge and backfill a hole be reduced to a minimum. Therefore, any reduction in the present time for hand shoveling the backfill into a hole would result in an increase in the productivity of the mine. Conversely, any delays caused by broken primer cord can reduce the productivity of the mine drastically.

The present invention provides a novel hole filling machine which permits backfilling of a hole containing an explosive quickly and safely without hand shoveling. Furthermore, the hole filling machine of the invention provides safeguards against damage to the primer cord. Moreover, the design of the hole filling machine provides safety shielding for the operating components. Also, the hole filling machine can accommodate holes of sizes requiring varying quantities of backfill material. In addition, the hole filling machine of the invention enables the operator to visually observe the initial positioning of the machine directly over the hole and the backfilling at close range. Further, the hole filling machine can be operated by one man, and if desired, the operator also can place the explosive charge and the primer cord from his position on the machine prior to backfilling the hole so the entire operation can be conducted by a single individual.

Other benefits and advantages of the present invention will be apparent from the following description and the accompanying drawings in which:

FIG. 3 is an enlarged side elevation in section of the blade assembly of the hole filling machine shown in FIG. 1;

FIG. 4 is an enlarged top view of the blade assembly of the hole filling machine shown in FIG. 1; and FIG. 5 is a greatly enlarged side elevation of the safety switch mechanism of the hole filling machine shown in FIG. 1.

Figure 1:
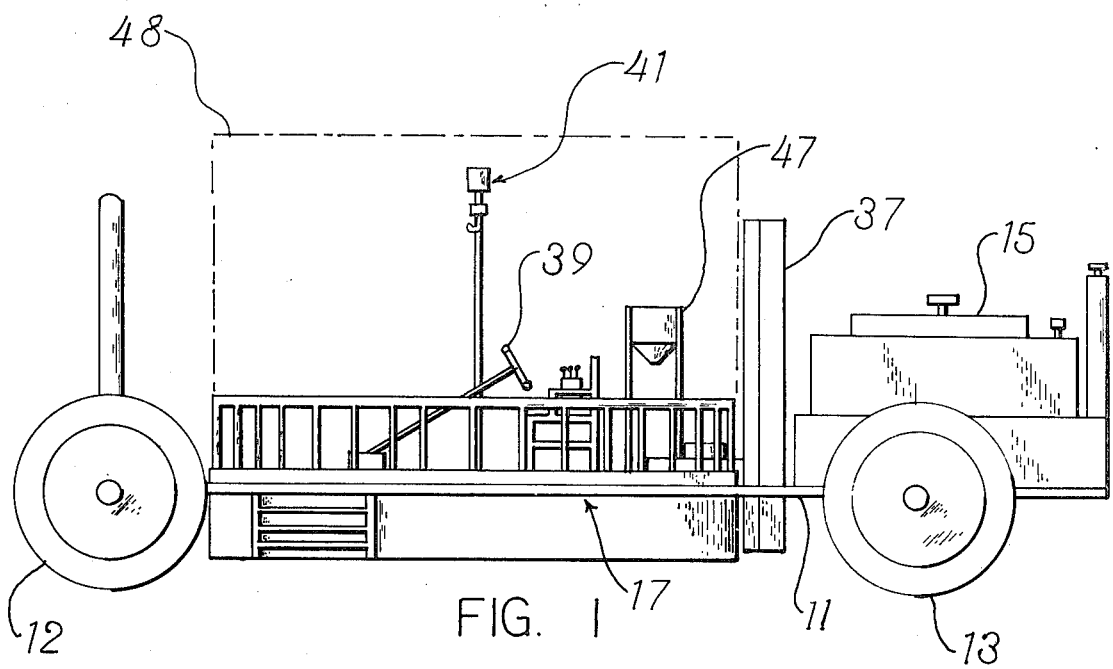
FIG. 1 is a side elevation of one form of the novel hole filling machine of the present invention.
Figure 2:
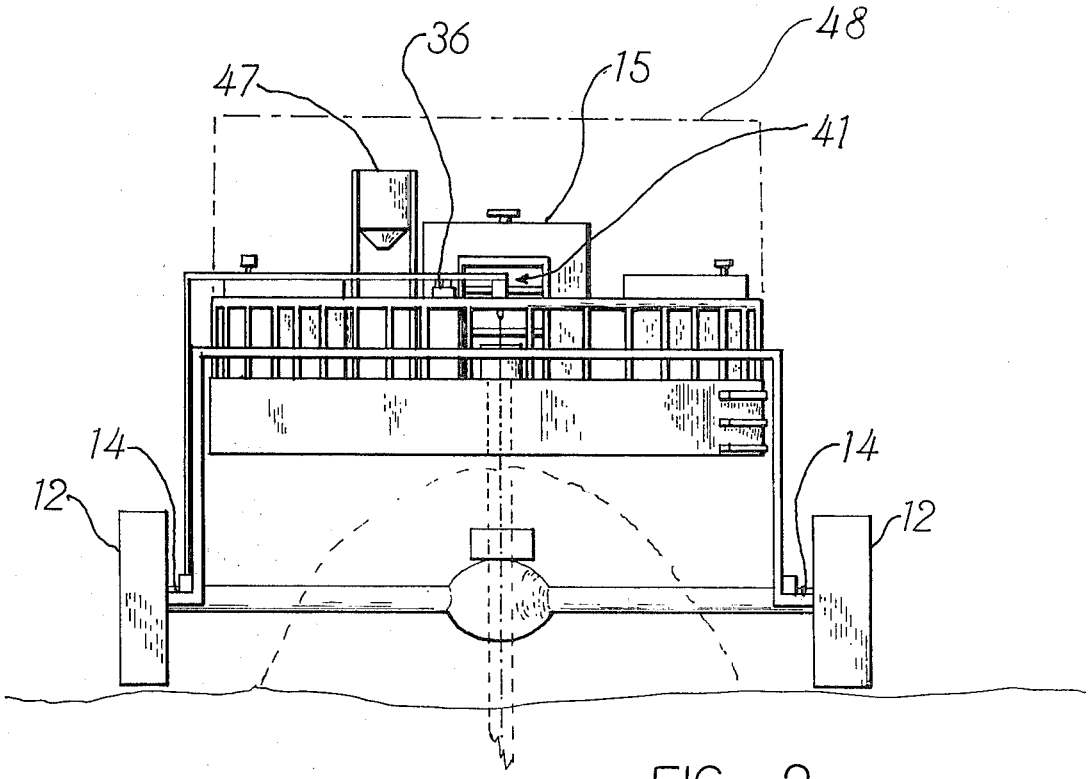
FIG. 2 is a front elevation of the hole filling machine shown in FIG. 1.

As shown in the drawings, one form of the novel hole filling machine of the present invention comprises a frame 11 having front wheels 12 and rear wheels 13. Front wheels 12 are attached to frame 11 by stub axles 14 (FIG. 2) so that the vehicle has clearance to be positioned over holes with relatively high piles of backfilling material. The vehicle advantageously is powered by an internal combustion engine 15 mounted on the rear portion of the frame 11.

A blade assembly 17 is suspended horizontally from the forward portion of frame 11. The assembly 17 shown in detail in FIGS. 3 and 4 includes a housing 18 in which is disposed a rotatable hollow vertical shaft 19. The shaft 19 is axially aligned with a central opening of housing 18. Shaft 19 is retained in housing 18 by a ring bearing 21 which engages corresponding slots 22 and 23 in the shaft and in a housing sleeve portion 24, respectively. Shaft 19 has a plurality of arcuate blades 26 extending outwardly therefrom toward the periphery of housing 18. Shaft 19 is driven by hydraulic motor 27 through a chain 28 connected between sprocket 29 affixed to the upper end of the shaft and a second sprocket 30 on shaft 31 of motor 27. Arcuate blades 26 may have spaced teeth 33 extending downwardly from the lower edge of the blades to facilitate movement of the backfill material.

An operator's seat 34 is affixed to the upper surface of housing 18 adjacent the central opening of sleeve 24 and shaft 19. A protective fence or barrier 35 advantageously is affixed to the periphery of the upper surface of housing 18. Controls 36 and a steering wheel 39 are located adjacent seat 34 for the convenience of the operator. Controls 36 operate engine 15 as well as hydraulic motor 27 connected thereto by a linkage (not shown). Through suitable tubing and valving (not shown), controls 36 activate the movement of the vehicle and the rotation of shaft 19 and blades 26 extending therefrom. Also, controls 36 activate cylinders 37 connecting housing 18 with frame 11 through supports 38 to provide vertical adjustment of assembly 17.

A safety switch mechanism 41 is mounted above the central opening of the housing 18 on a bracket 42. Switch 41 may include as shown in FIG. 5 a solenoid 43, a conventional tension adjustment device such as spring 44 and a hook 45. One or more hoppers 47 or similar containers may be mounted on the vehicle to provide storage for explosives, primer cord, etc. The vehicle also may include a canopy or enclosure 48 to protect the operator and the working components from the elements.

In the operation of the hole filling machine of the present invention as shown in the drawings, an operator sitting on seat 34 using controls 36 and steering wheel 39 advances the machine into a position straddling a hole with the central opening of housing 18 directly over the hole. From his seat, the operator can visually observe when the central opening is over the hole.

The operator then lowers a cast primer attached to the end of a primer cord 50 into the bottom of the hole, forms a loop in the upper end of the primer cord and places the loop over hook 45 of the safety switch mechanism 41. The tension in the primer cord 50 is controlled with spring 44. Next an explosive charge such as ammonium nitrate is loaded into the hole from hopper 47 with a conduit (not shown).

Thereafter, the operator lowers assembly 17 into the pile of soil surrounding the hole by activating cylinders 37 using controls 36. Actuating additional controls 36 starts hydraulic motor 27 initiating rotation of shaft 19 and blades 26 so the arc of the blades moves the soil piled around the hole toward the center of the assembly 17 and into the hole. As the size of the pile of soil is reduced, the assembly 17 is lowered to insure the blades 26 are moving a maximum amount of soil in a minimum period of time.

Since the primer cord 50 which is attached to safety switch 41 extends downwardly through the central opening of housing 18, the rotation of shaft 19 and blades 26 does not interfere with the primer cord. However, if a rock or other obstruction causes a significant increase in the tension in the primer cord, switch 41 will be actuated, stopping motor 27 and the rotation of the blades 26 to prevent damage to the primer cord. Also, switch 41 stops engine 15 so the machine cannot be moved inadvertently while the primer cord 50 still is attached to switch 41.

The above description and the accompanying drawings show that the present invention provides a novel machine for filling holes quickly and efficiently. Also, the hole filling machine of the invention enables holes containing explosive charges to be backfilled safely without hand shoveling. More particularly, the machine provides safeguards against the possibility of damage to the primer cord. Furthermore, the machine of the invention provides protection for the operator and other persons working around the machine. Moreover, the hole filling machine can accommodate different sizes of holes with varying quantities of backfill material. In addition, the design of the hole filling machine permits the operator to position the machine directly over a hole without assistance and to observe visually the positioning and the backfilling operations at close range. Also, the operator can place the primer cord and the explosive charge from his seat on the machine prior to backfilling so the complete operation can be performed by a single individual.

It will be apparent that various modifications can be made in the particular hole filling machine described in detail above and shown in the drawings within the scope of the invention. For example, the vehicle employed may be a fork lift truck or another suitable wheeled or tracked vehicle or carrier on which the blade assembly 17 can be mounted for vertical movement as described above. However, such a vehicle may not have the advantages of the machine shown in the drawings. Therefore, the invention is to be limited only by the following claims.

What is claimed is:

1. A hole filling machine comprising a vehicle having a frame; drive means for said vehicle; a substantially horizontal rotatable blade assembly adjustably suspended from said frame, said blade assembly including a circular housing with a central opening, a rotatable hollow vertical shaft disposed axially of said central opening of said housing, a plurality of arcuate blades extending outwardly from said rotatable shaft toward the periphery of said housing; drive means for said rotatable shaft; safety switch means disposed above said central opening; actuating means for said switch means; and means operatively connecting said safety switch means with said vehicle drive means and said shaft drive means.

2. A hole filling machine according to claim 1 wherein said housing is disposed within an area circumscribed by said frame.

3. A hole filling machine according to claim 1 including means for raising and lowering said blade assembly.

4. A hole filling machine according to claim 1 including an operator's seat on said housing adjacent said central opening of said housing.

5. A hole filling machine according to claim 4 wherein control means are located adjacent said operator's seat.

6. A hole filling machine according to claim 1 wherein said drive means for said vehicle includes an internal combustion engine and hydraulic motors.

7. A hole filling machine according to claim 1 wherein said shaft drive means includes a hydraulic motor.

8. A hole filling machine according to claim 1 wherein said housing includes an upwardly extending peripheral protective barrier.

9. A hole filling machine according to claim 1 wherein said arcuate blades have downwardly extending teeth.

10. A hole filling machine according to claim 1 wherein said safety switch means includes a solenoid switch and spring.

* * * * *